US007574958B2

(12) United States Patent
Forche et al.

(10) Patent No.: US 7,574,958 B2
(45) Date of Patent: Aug. 18, 2009

(54) PRINTING MATERIAL SHEET GRIPPER AND METHOD FOR PRODUCING THE SHEET GRIPPER

(75) Inventors: Jens Forche, Freinsheim (DE); Karl-Heinz Helmstädter, Heidelberg (DE); Hans-Peter Hiltwein, Waghäusel (DE); Dieter Stephan, Heidelberg (DE); Volker Weyde, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 479 days.

(21) Appl. No.: 11/221,632

(22) Filed: Sep. 8, 2005

(65) Prior Publication Data

US 2006/0048661 A1 Mar. 9, 2006

(30) Foreign Application Priority Data

Sep. 8, 2004 (DE) ..... 10 2004 043 330

(51) Int. Cl.
*B41F 21/04* (2006.01)
*B41F 21/10* (2006.01)

(52) U.S. Cl. ..... 101/408; 101/409; 271/277

(58) Field of Classification Search ..... 101/408, 101/409, 246; 271/277
See application file for complete search history.

(56) References Cited

U.S. PATENT DOCUMENTS

| | | | | |
|---|---|---|---|---|
| 1,269,687 | A | 6/1918 | Dittman | 101/412 |
| 3,513,453 | A | 5/1970 | Fow | 365/55 |
| 3,563,536 | A | 2/1971 | Hanzlik et al. | 198/803.7 |
| 4,823,698 | A * | 4/1989 | Ruger et al. | 101/409 |
| 4,970,955 | A | 11/1990 | Sondergeld et al. | 101/409 |
| 5,390,600 | A * | 2/1995 | Thunker | 101/408 |
| 5,518,231 | A * | 5/1996 | Reddy | 271/277 |
| 2004/0009339 | A1 * | 1/2004 | Case | 428/319.3 |
| 2008/0245250 | A1 * | 10/2008 | Kato | 101/408 |

FOREIGN PATENT DOCUMENTS

| | | |
|---|---|---|
| DE | 539406 | 1/1931 |
| DE | 1 804 741 | 8/1969 |
| DE | 1 900 057 | 10/1969 |
| DE | 31 46 836 A1 | 8/1982 |
| DE | 37 10 756 A1 | 1/1988 |
| DE | 37 39 169 C1 | 6/1989 |

* cited by examiner

*Primary Examiner*—Leslie J Evanisko
(74) *Attorney, Agent, or Firm*—Laurence A. Greenberg; Werner H. Stemer; Ralph E. Locher

(57) ABSTRACT

In a sheet gripper, a dimensionally stable base material and an elastic clamping surface material are connected to each other in a form-fitting manner. The elastic clamping surface material functions as a clamping surface of the sheet gripper. This forms a sheet gripper having a long service life and is easy manufacture.

8 Claims, 6 Drawing Sheets

PRINTING MATERIAL SHEET GRIPPER AND METHOD FOR PRODUCING THE SHEET GRIPPER

BACKGROUND OF THE INVENTION

1. Field of the Invention

The present invention relates to a sheet gripper for gripping printing material sheets, in which a dimensionally stable base material and an elastic clamping surface material, which forms a clamping surface, are joined to each other.

Such a sheet gripper is described in published, non-prosecuted German patent application DE 31 46 836 A1. In the case of this sheet gripper from the prior art, over the course of time the clamping surface material can separate from the base material. The separated base material can wander about in the machine and cause consequential damage. For example, it can adhere to a printing material sheet and, together with the latter, run into a press nip and increase the printing pressure therein excessively, so that cylinders forming the press nip or their mountings are damaged.

German patent DE 37 39 169 C1, corresponding to U.S. Pat. No. 4,970,955, is not able to make any truly helpful contribution to solving the problem thrown up. According to the last-named prior art, the sheet grippers cooperate with a gripper pad, whose clamping surfaces are formed from an elastic plastic. By contrast, the clamping surfaces of the sheet grippers are coated with a hard material.

SUMMARY OF THE INVENTION

It is accordingly an object of the invention to provide a printing material sheet gripper and a method for producing the sheet gripper that overcomes the above-mentioned disadvantages of the prior art devices and methods of this general type, which has a long service life.

The sheet gripper according to the invention has a dimensionally stable base material and an elastic clamping surface material, which forms a clamping surface, that are joined to each other. The sheet gripper is characterized in that the base material and the clamping surface material are joined to each other in a form-fitting manner.

A form-fitting connection is one that connects two elements together due to the shape of the elements themselves, as opposed to a force-locking connection, which locks the elements together by force external to the elements.

In the case of the sheet gripper according to the invention, the clamping surface material does not separate from the base material even as a result of an extremely high number of gripper closure load cycles, so that the service life of the sheet gripper is increased considerably by the aforesaid form fit between the two materials. Additional advantages are the reduced expenditure on inspection and repair and the avoidance of the aforesaid consequential damage.

In one development, at least one cut-out is introduced into the base material and is at least partly filled with the clamping surface material. The cut-out can be a passage hole or a gap in a comb contour of the sheet gripper or its base material.

In a further development, the sheet gripper or its base material is at least partly encased in the clamping surface material.

In any further development, the clamping surface material, as viewed along the clamping surface, has a projection beyond the base material and, consequently, the clamping surface material forms a gripper tip of the sheet gripper.

According to a further development, the clamping surface material in the region of the aforesaid gripper tip extends set back from the latter, as viewed transversely with respect to the clamping surface.

The present invention also includes a gripper system that contains sheet grippers constructed in accordance with the invention or one of its developments and gripper pads cooperating with these sheet grippers. The gripper system can belong to a sheet transport device that belongs to a machine for processing printing material sheets, which machine likewise belongs to the present invention.

Finally, the present invention also includes a method for producing the sheet gripper. In the method according to the invention for producing a sheet gripper, a dimensionally stable base material is joined to an elastic clamping surface material, and is characterized in that the base material and the clamping surface material are joined to each other in a form-fitting manner. The method according to the invention is suitable for producing the sheet gripper according to the invention.

In a further development, the elastic clamping surface material is used in the form of a cap and the cap is slipped over the base material in order to join the two materials to each other in a form-fitting manner. In this case, the cap can be snapped into the base material as a snap closure.

According to a further development of the method according to the invention, the base material and the clamping surface material are joined to each other in a form-fitting manner by injection molding of the clamping surface material.

According to a further development, by use of the injection molding, shaping of the clamping surface of the sheet gripper is carried out without any material removal.

Other features which are considered as characteristic for the invention are set forth in the appended claims.

Although the invention is illustrated and described herein as embodied in a printing material sheet gripper and method for producing the sheet gripper, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
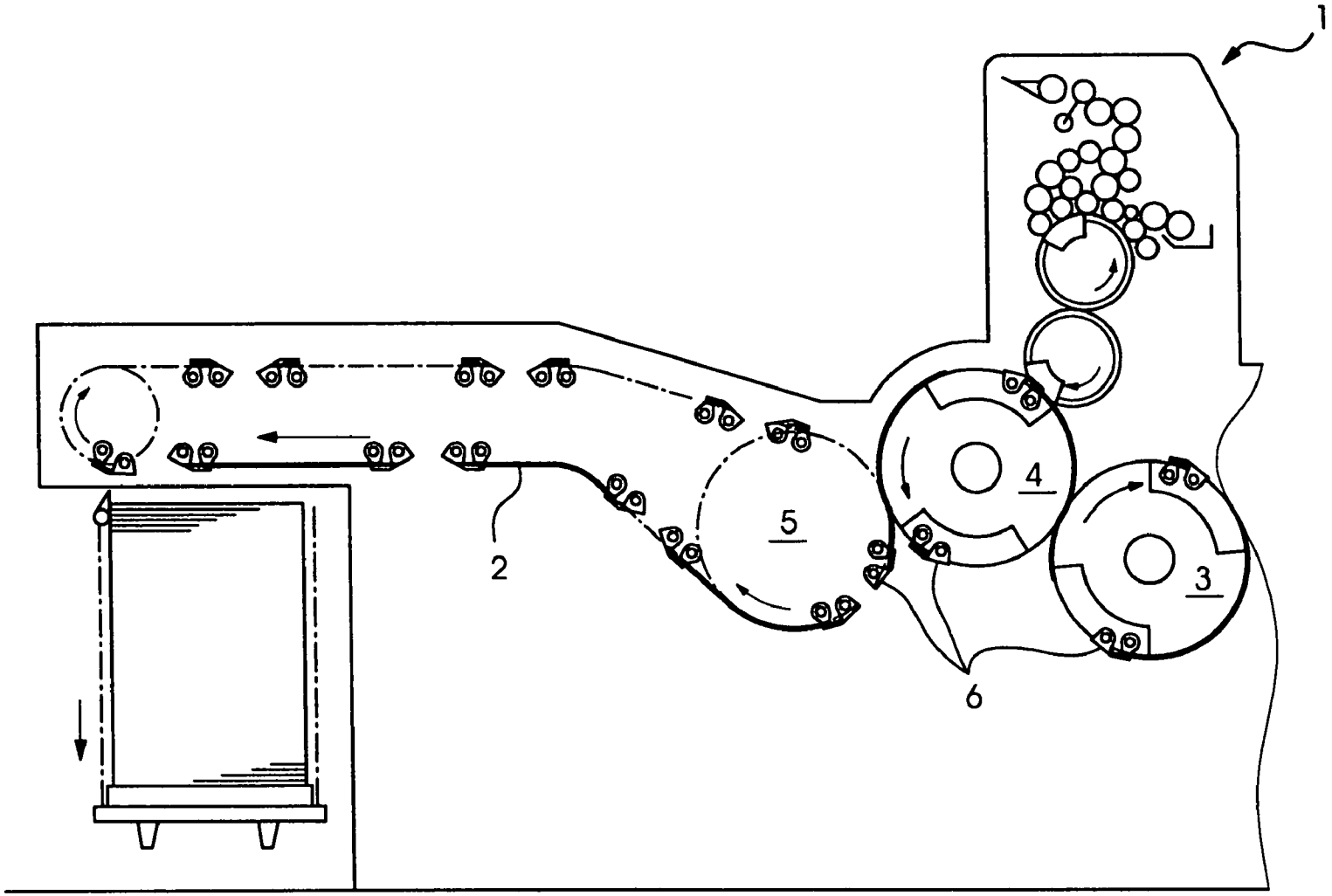
FIG. 1 is a diagrammatic, side view of a press.

Referring now to the figures of the drawing in detail and first, particularly, to FIG. 1 thereof, there is shown a machine 1 for processing printing material sheets 2. The machine 1 is a rotary press for lithographic offset printing and contains sheet transport devices, which includes a sheet transport drum 3, an impression cylinder 4 and a chain conveyor 5. The sheet transport devices in each case contain bridge-like gripper systems 6.

Figure 2:
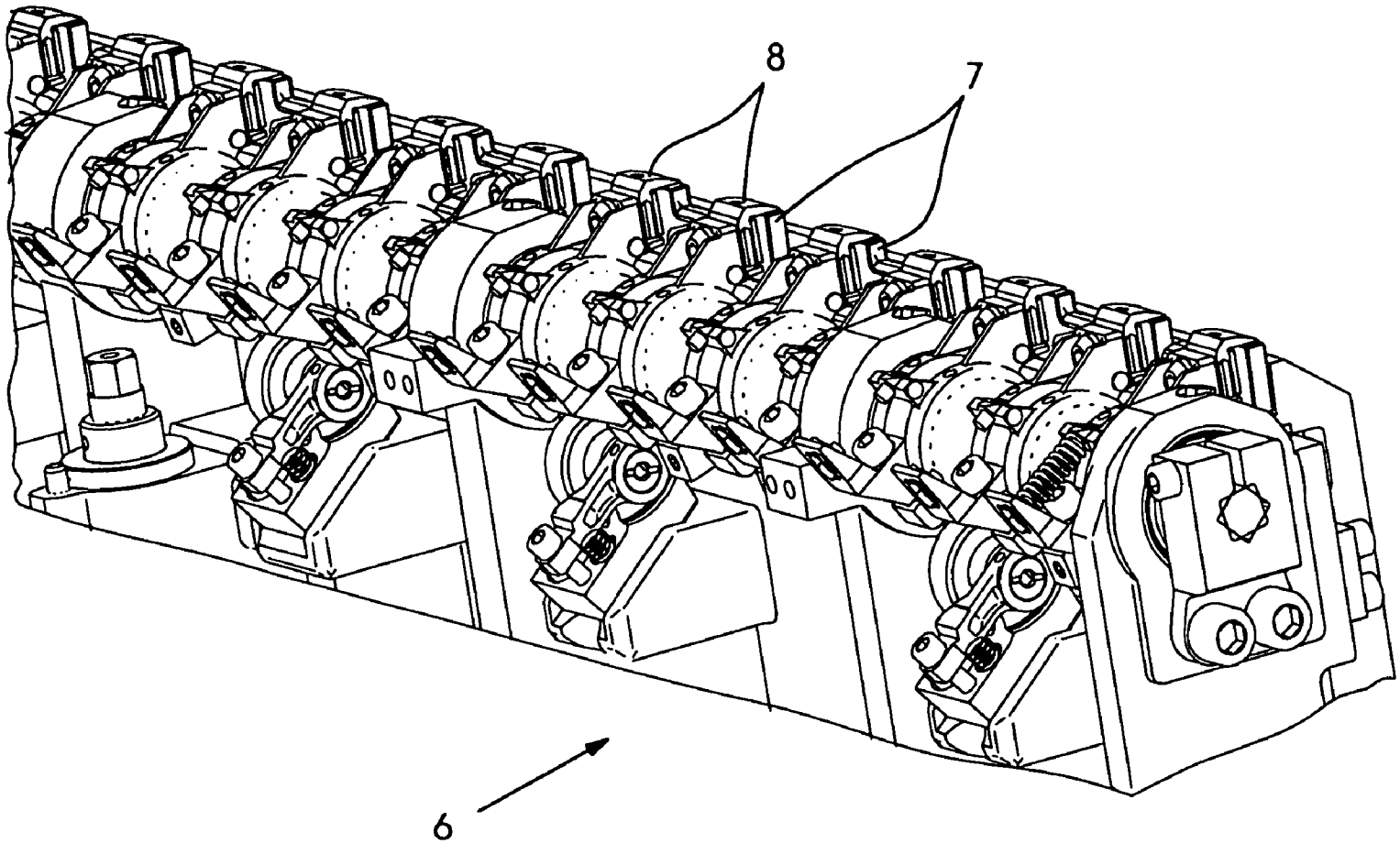
FIG. 2 is a diagrammatic, perspective view of a gripper system of the press shown in FIG. 1 according to the invention.

FIG. 2 shows that each gripper system 6 contains a gripper pad 7 and sheet grippers 8 which can be pivoted relative to the latter and are disposed in a row. The gripper systems 6 are used to hold a leading edge of the respective printing material sheet 2.

Figure 3:
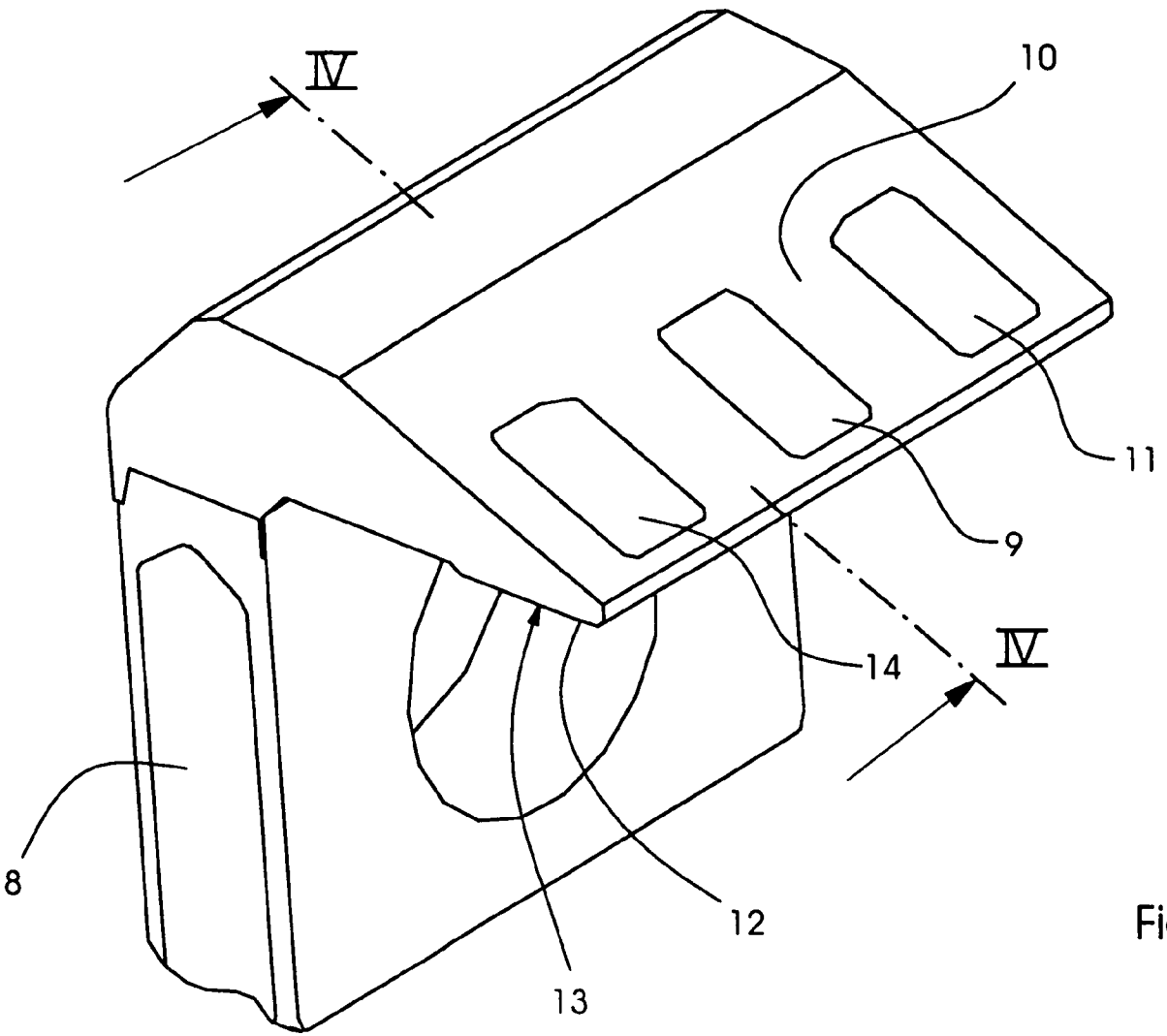
FIG. 3 is a diagrammatic, perspective view of a sheet gripper of the gripper system shown in FIG. 2.

FIG. 3 shows that each sheet gripper 8 has a gripper core 9 and a casing 10 that encases the gripper core 9.

The gripper core 9 is formed of metal as a base material 11. The casing 10 is formed of a clamping surface material 12, that is to say a material that forms a clamping surface 13 of the sheet gripper 8. By the clamping surface 13, the sheet gripper 8 holds a printing material sheet 2 firmly when gripping the latter. The clamping surface material 12 is resilient and a plastic, preferably polyurethane.

With the exception of elevated form-fitting elements 14 of the gripper core 9, the casing 10 covers the latter substantially completely. The sheathing, in principle on all sides, of the hook-like end with the clamping surface material 12 is advantageous with respect to resistance of the sheet gripper 8 to external chemical influences. The clamping surface material 12 which, as a plastic coating, forms an encapsulation of the hook-like end of the gripper core 9, protects the latter against the action of aggressive substances. In addition, the service life of the sheet gripper 8 is thereby increased.

Figure 4:
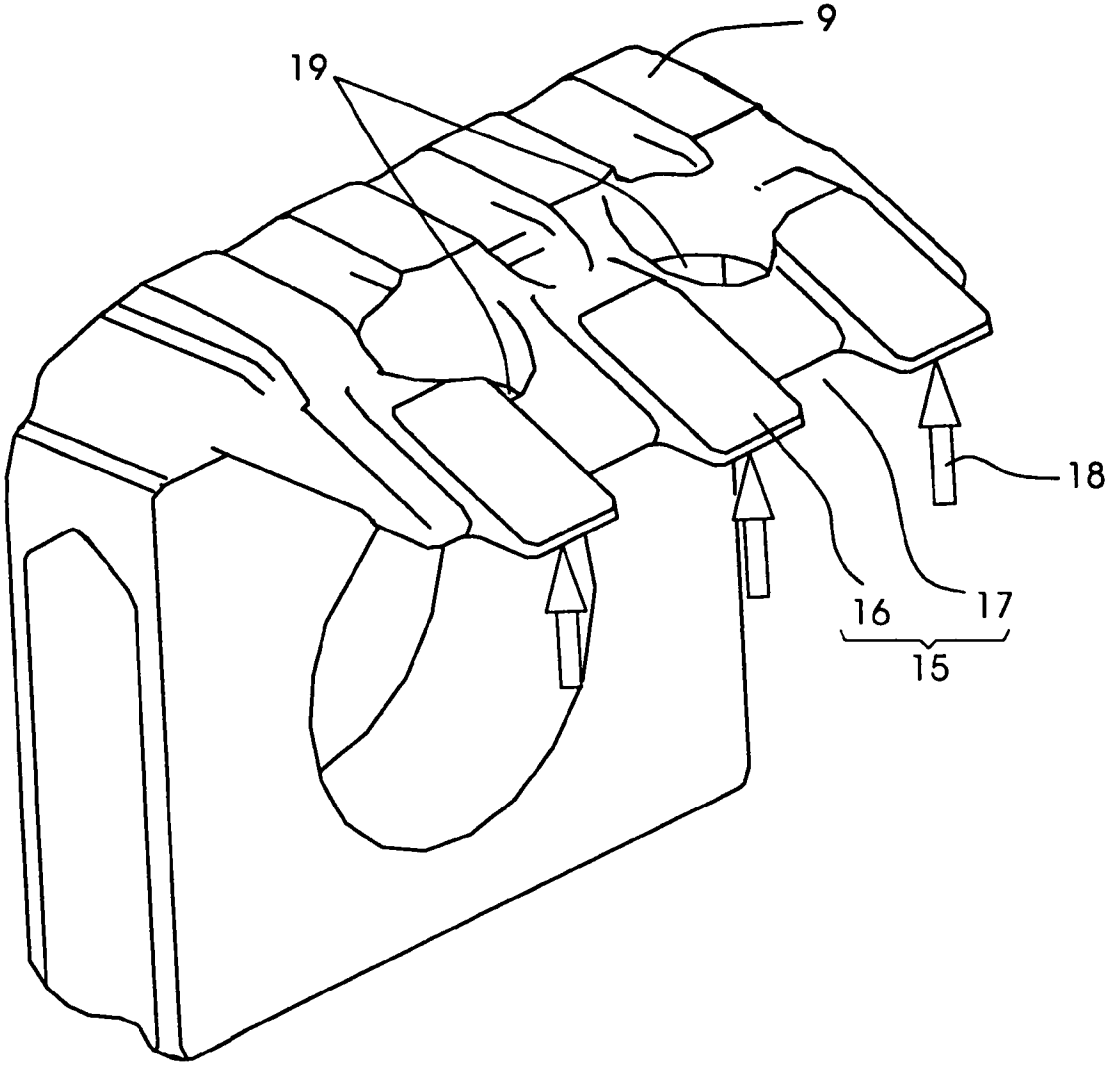
FIG. 4 is a diagrammatic, perspective view of a gripper core of the sheet gripper shown in FIG. 3.

FIG. 4 shows a blank of the sheet gripper 8, that is to say the gripper core 9 before it is coated with the casing 10. The gripper core 9 has a comb contour 15 at its hook-like end, with prongs 16 and gaps 17 lying between. The clamping reaction forces 18 that act on the prongs 16 when gripping the printing material sheet 2 are illustrated symbolically by arrows.

The prongs 16 can move toward each other flexibly to a certain extent when the sheet gripper 8 encounters the gripper pad 7 or the printing material sheet 2 lying on the latter. This springing of one or the other prongs 16 occurs when, on account of fabrication or mounting tolerances of the sheet gripper 8 or surface irregularities of the printing material sheet 2, the prong 16 is placed on the latter slightly earlier than the remaining prongs 16, and prevents what is known as gripper bounce. In the event of gripper bounce, the sheet gripper 8 springs back somewhat temporarily from the printing material sheet 2 when it encounters the latter. As a result of the springing of the prongs 16, the sheet gripper 8 closes in a damped manner and without bouncing back. With regard to a certain compliance of the sheet gripper 8 as it closes gently, it is also advantageous that, when the sheet gripper 8 is finished (see FIG. 3), that is to say after the gripper core 9 has been coated with the clamping surface material 12, the clamping surface material 12 is not just located on the underside of the prongs 16 but also between the prongs 16.

Introduced into the hook-like end of the gripper core 9 are passage holes 19 in the form of drilled holes, which are aligned with the gaps 17, that is to say are in each case arranged between the prongs 16. The passage holes 19 and the gaps 17 in each case form depressed form-fitting elements or cut-outs, which are filled completely with the clamping surface material 12 after the clamping surface material 12 has been applied to the gripper core 9 as the casing 10 by a suitable coating process, preferably injection molding. With their exposed upper sides not covered by the casing 10, the prongs 16 form the aforesaid elevated form-fitting elements 14 (see FIG. 3) on the rear of the gripper core 9. The gaps, passage holes 19 and elevated form-fitting elements 14 interengage with the casing 10 after the curing of the latter, carried out on the gripper core 9, in such a way that the casing 10 is seated sufficiently durably on the gripper core 9 merely by this form fit. The elevated and depressed form-fitting elements 14 form undercuts, so to speak, which fix the clamping surface material 12. This is advantageous from a fabrication point of view, since therefore no primer or adhesion promoter needs to be applied to the gripper core 9 before it is coated with the clamping surface material 12.

Figure 5:
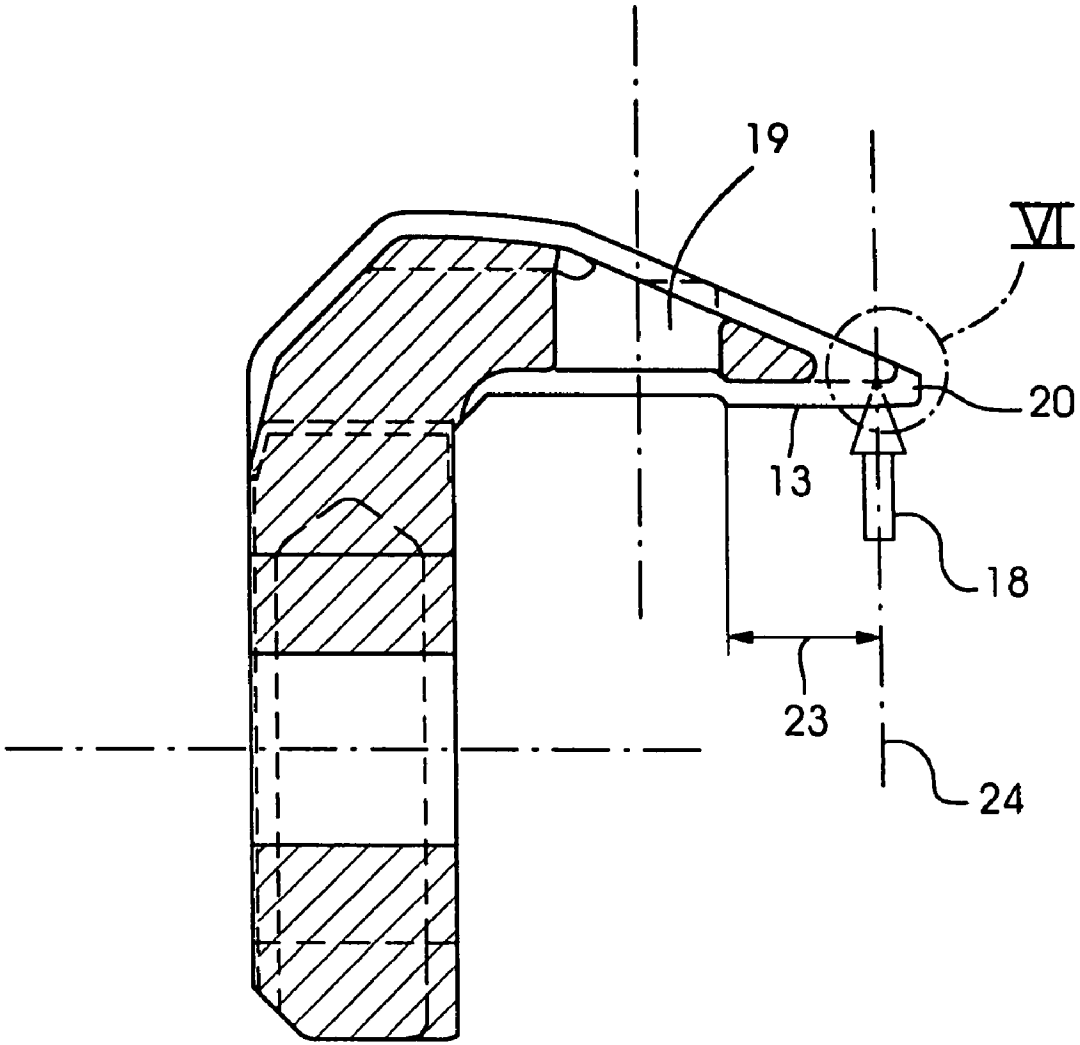
FIG. 5 is a diagrammatic, sectional view of the sheet gripper taken along the section line V-V shown in FIG. 3.
Figure 6:
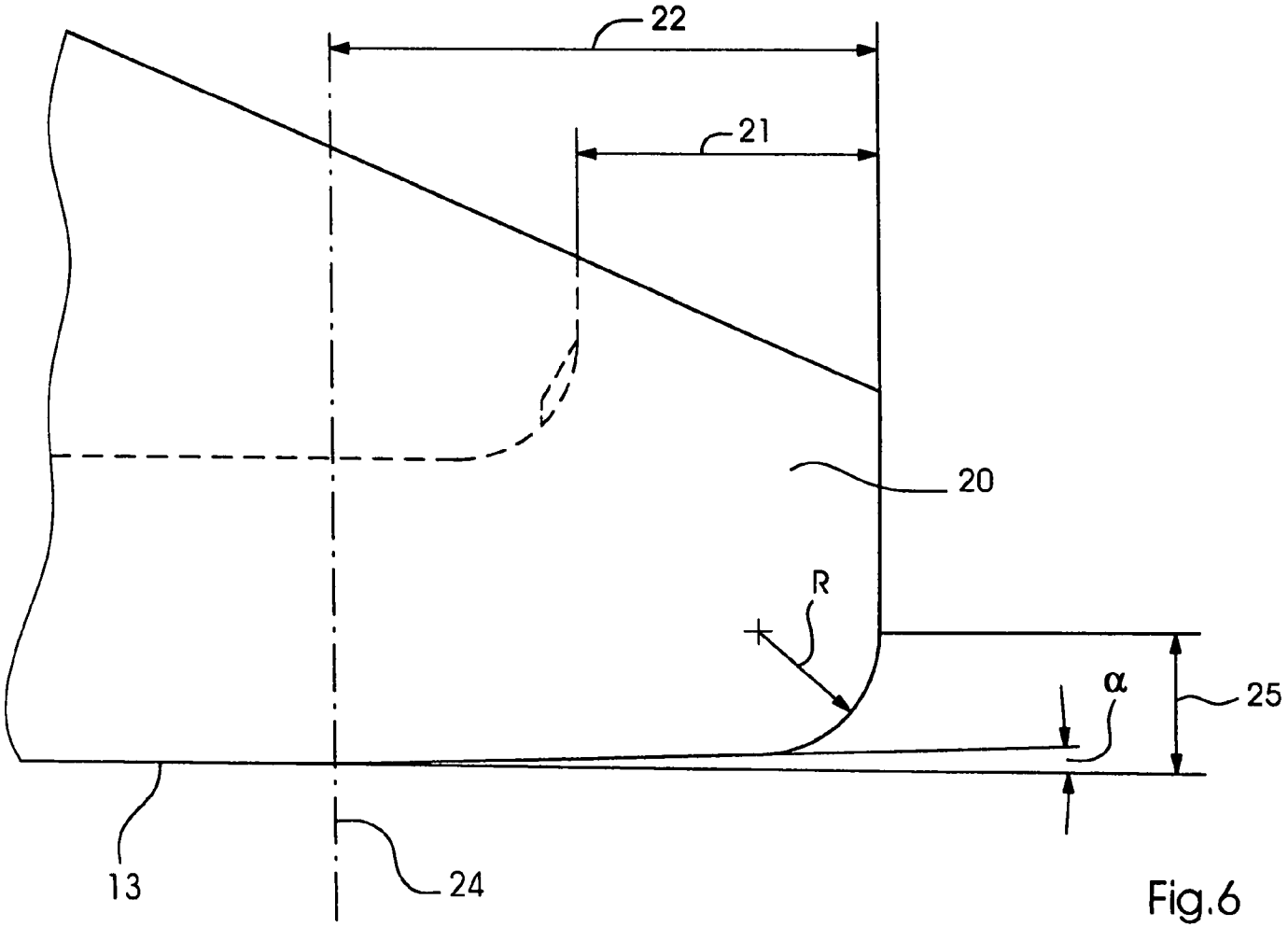
FIG. 6 is a detailed illustration of a gripper tip of the sheet gripper, corresponding to the detail VI shown in FIG. 5.

FIGS. 5 and 6 show the gripper core 9 with the casing 10 applied thereto. The casing 10 projects with a projection 21 beyond the prongs 16 and forms a gripper tip 20. In order that the gripper tip 20 does not bend upward to a damaging extent under the action of the clamping reaction force 18, the clamping surface 13 extends in a passive region 22 so as to be set back relative to an active region 23 of the clamping surface 13. This offset 25 increases continuously toward the gripper tip 20 and ensures that the clamping surface 13, when gripping a printing material sheet 2, comes into contact with the latter only in its active region 23 but not in its passive region 22. A line of action 24 of the clamping reaction forces 18 determines the boundary between the active region 23 and passive region 22. The line of action 24 of the force is oriented substantially at right angles to the clamping surface 13 and toward the prongs 16. Within the passive region 22, the clamping surface 13 is provided with a chamfer for ensuring an offset 25 to a sufficient extent, and with a convexity adjacent thereto.

FIG. 6 shows that the clamping surface 13 is beveled over at a shallow angle $\alpha$ in its passive region 22 in order to form the chamfer and is rounded with a radius R in order to form a convexity.

The sheet gripper is produced by the now described process.

The metallic gripper core 9 is inserted into an injection mold as a molding core and is aligned exactly therein with reference to the clamping surfaces 13 to be produced. After that, the plastic is injected into the injection mold, penetrating into the passage holes 19 and gaps 17 in the process and filling these cut-outs. During the injection molding operation, not only is the spraying of plastic onto one side of the hook-like end of the gripper core 9 carried out but, in principle, it is completely encapsulated with the plastic. As a result, the liquid pressure of the plastic in the injection mold acts on all sides in such a way that, during the subsequent curing of the plastic, no deformations impairing the function can occur, such as direction-dependent and excessive shrinkage of the casing 10 and, in particular, of the clamping surface 13 which is important for the function. Following the complete curing of the plastic or of the casing 10 formed of the latter, it is joined absolutely durably to the gripper core 9 and the finished sheet gripper 8 is removed from the injection mold.

Reworking of the clamping surface 13 by material removal is not necessary at all, in account of the aforementioned and particularly exact alignment of the gripper core 9 in the injection mold. The sheet gripper has already reached its final form and readiness for use following the coating of the gripper core 9 with the clamping surface material 12. As a result of the omission of reworking by removing material, fabrication time and costs are saved, which is very advantageous in view of the high numbers of sheet grippers 8 fabricated by mass production.

Finally, reference is to be made to the possibility of a modification to the sheet gripper 8 not specifically illustrated in the drawing. In this modification, in the event of wear of the clamping surface caused by abrasion, the casing can be pulled off the gripper core by the operating personnel within the context of maintenance work, with elastic widening of the casing, and replaced by a new casing. The operating personnel can simply plug this new casing 10 onto the hook-like end of the gripper core like a protective cap. In the modification, too, the form fit between the gripper core and casing is aligned with the line of action of the clamping reaction force in such a way that there is no risk of the casing tearing off the gripper core, effected by the clamping reaction force.

In the modification, the casing has knobs on the inside that are complementary to the passage holes in the gripper core and which, when the casing is plugged onto the gripper core, latch or snap into the passage holes.

This application claims the priority, under 35 U.S.C. § 119, of German patent application No. 10 2004 043 330.5, filed Sep. 8, 2004; the entire disclosure of the prior application is herewith incorporated by reference.

We claim:

1. A sheet gripper for gripping printing material sheets, the sheet gripper comprising:

a dimensionally stable base material; and an elastic clamping surface material forming a clamping surface, being joined to said base material, said clamping surface material and said base material being joined to each other in a form-fitting manner, said clamping surface material having the characteristics of a material joined by injection molding the clamping surface material onto said base material;

said base material having at least one cutout formed therein and said cutout being at least partly filled with said clamping surface material, said base material including a comb contour, said comb contour having a gap, said cutout being defined by said gap.

2. The sheet gripper according to claim 1, wherein said base material is at least partly encased in said clamping surface material.

3. The sheet gripper according to claim 1, wherein said clamping surface material, as seen along said clamping surface, has a projection extending beyond said base material and defines a gripper tip.

4. The sheet gripper according to claim 3, wherein on a side of said gripper tip, said clamping surface material extends set back from said gripper tip, as viewed transversely with respect to said clamping surface.

5. A gripper system, comprising:

sheet grippers formed of a dimensionally stable base material and an elastic clamping surface material forming a clamping surface, being joined to said base material, said clamping surface material and said base material being joined to each other in a form-fitting manner, said clamping surface material having the characteristics of a material joined by injection molding the clamping surface material onto said base material;

said base material having at least one cutout formed therein and said cutout being at least partly filled with said clamping surface material, said base material including a comb contour, said comb contour having a gap, said cutout being defined by said gap; and gripper pads cooperating with said sheet grippers.

6. A machine for processing printing material sheets, comprising:

a sheet transport device having a gripper system, said gripper system containing:

sheet grippers formed of a dimensionally stable base material and an elastic clamping surface material forming a clamping surface, being joined to said base material, said clamping surface material and said base material being joined to each other in a form-fitting manner, said clamping surface material having the characteristics of a material joined by injection molding the clamping surface material onto said base material;

said base material having at least one cutout formed therein and said cutout being at least partly filled with said clamping surface material, said base material including a comb contour, said comb contour having a gap, said cutout being defined by said gap; and gripper pads cooperating with said sheet grippers.

7. A method for producing a sheet gripper, which comprises the step of:

joining a dimensionally stable base material to an elastic clamping surface material forming a clamping surface, the base material and the clamping surface material being joined to each other in a form-fitting manner; and joining the clamping surface material and the base material to each other in a form-fitting manner by injection molding the clamping surface material onto the base material, the clamping surface material filling a gap of a comb contour of the base material.

8. The method according to claim 7, which further comprises carrying out a shaping of the clamping surface of the sheet gripper entirely without removing any material during the injection molding step.

* * * * *